United States Patent [19]

Forthmann

[11] 4,416,176

[45] Nov. 22, 1983

[54] CUTTER ASSEMBLY FOR CUTTING STRIP MATERIAL

[76] Inventor: Frederick Forthmann, 688 Pascack Rd., Washington Township, Washington County, N.J. 07675

[21] Appl. No.: 339,761

[22] Filed: Jan. 15, 1982

[51] Int. Cl.[3] ..... B26D 1/08

[52] U.S. Cl. ..... 83/582; 83/628; 83/640; 83/699

[58] Field of Search ..... 83/582, 628, 640, 699, 83/641

[56] References Cited

U.S. PATENT DOCUMENTS

| | | | |
|---|---|---|---|
| 2,778,421 | 1/1957 | Munschauer | 83/640 |
| 3,289,517 | 12/1966 | Brombach et al. | 83/640 |
| 4,220,063 | 9/1980 | Kiemer et al. | 83/640 X |

FOREIGN PATENT DOCUMENTS

| | | | |
|---|---|---|---|
| 1350786 | 12/1963 | France | 83/640 |

*Primary Examiner*—Frank T. Yost

*Attorney, Agent, or Firm*—McGlew and Tuttle

[57] ABSTRACT

A cutter assembly for cutting strip material into individual lengths particularly for cutting labels which include cloth material having polyester fibers which must be cut while operating with a heated blade comprises a fixed support with a fixed blade having a first side secured to the support and an opposite second side and having a top cutting edge over which the strip material to be cut is fed. A movable member is movable upwardly and downwardly relative to the fixed blade and carries vertically spaced apart pintles to laterally spaced locations which provide guideways at opposite sides of a movable blade assembly. The movable blade assembly includes a block portion having a guide pintle which extends between respective two pintles on each side thereof so as to prevent vertical movement of the block but permit its lateral displacement toward and away from the associated movable member. The movable blade assembly is biased by springs in a direction toward engagement with the movable member but it is held away from contacting engagement therewith by threaded adjustment screws which engage against the block portion of the movable blade assembly at two laterally spaced locations and two vertically spaced locations so as to provide an accurate adjustment of the movable blade assembly in respect to its associated movable member which thereby affects the adjust position of a movable blade portion relative to the fixed blade. The fixed blade advantageously includes an upstanding guide portion at one end providing a bearing surface for a marginal edge of the movable blade during its movement. The heater is advantageously carried by the movable blade so that the heating of the labels does not cause a contamination of the cutting area as the strip material moves over the fixed blade. The arrangement permits accurate adjustment of the movable blade relative to the fixed blade and ensures an accurate positioning and guiding thereof along with the movable member during the operation of the device.

6 Claims, 4 Drawing Figures

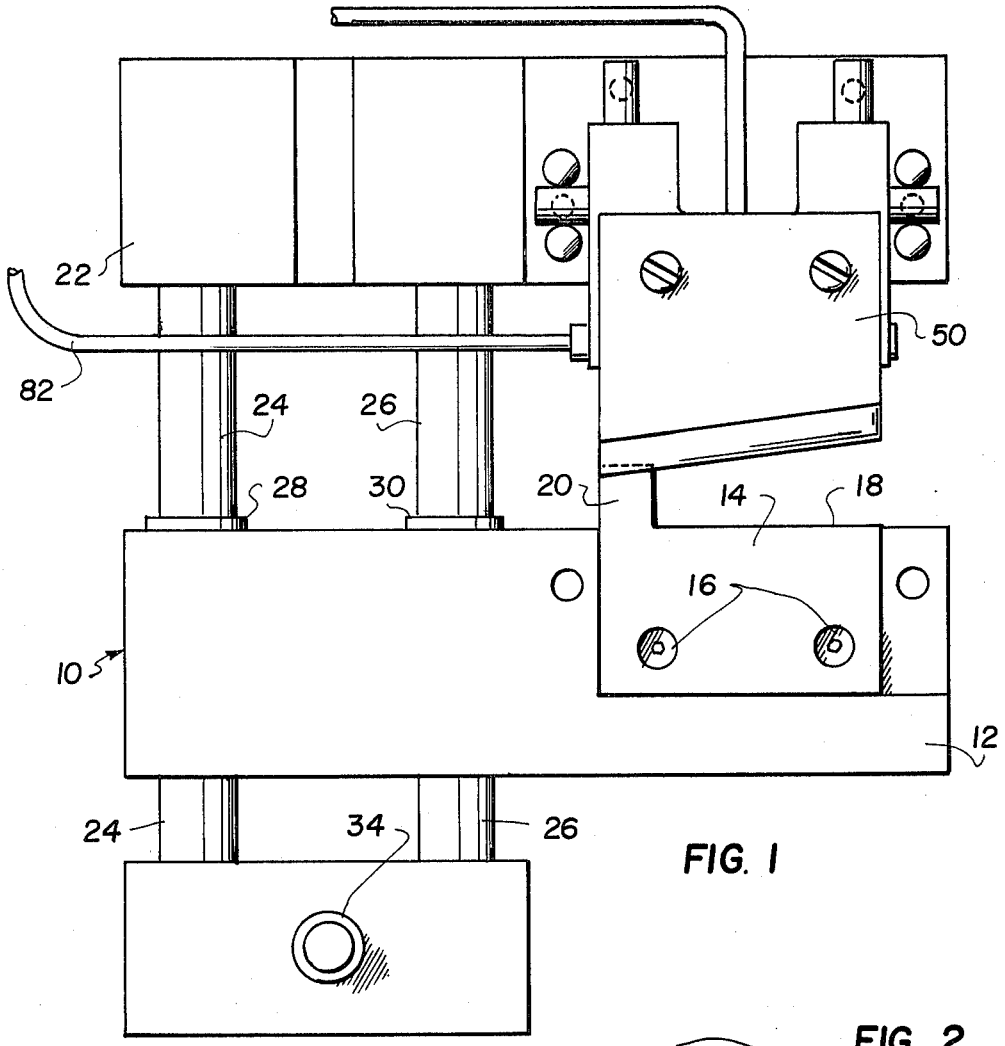
FIG. 1
FIG. 2
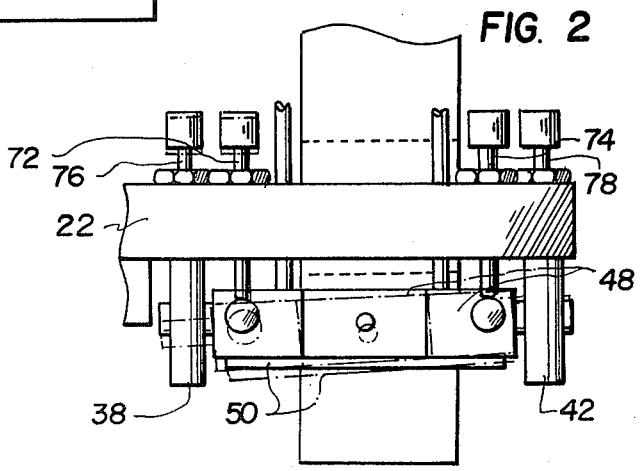

FIG. 3
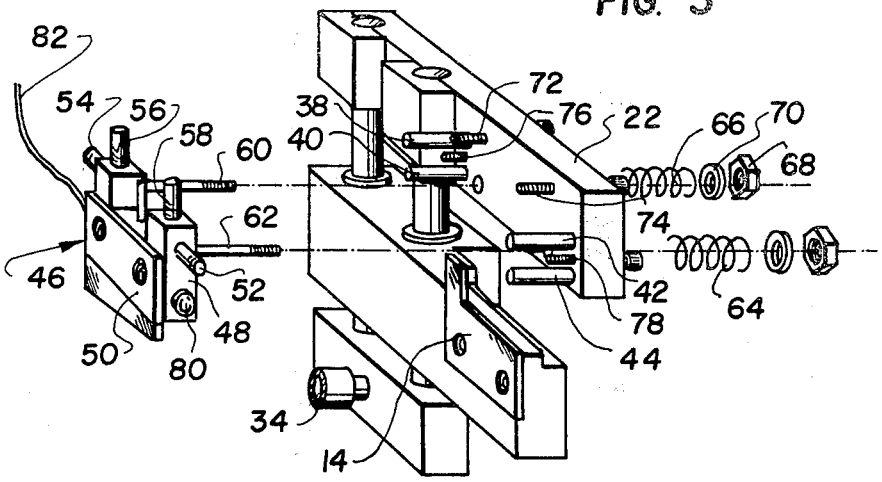
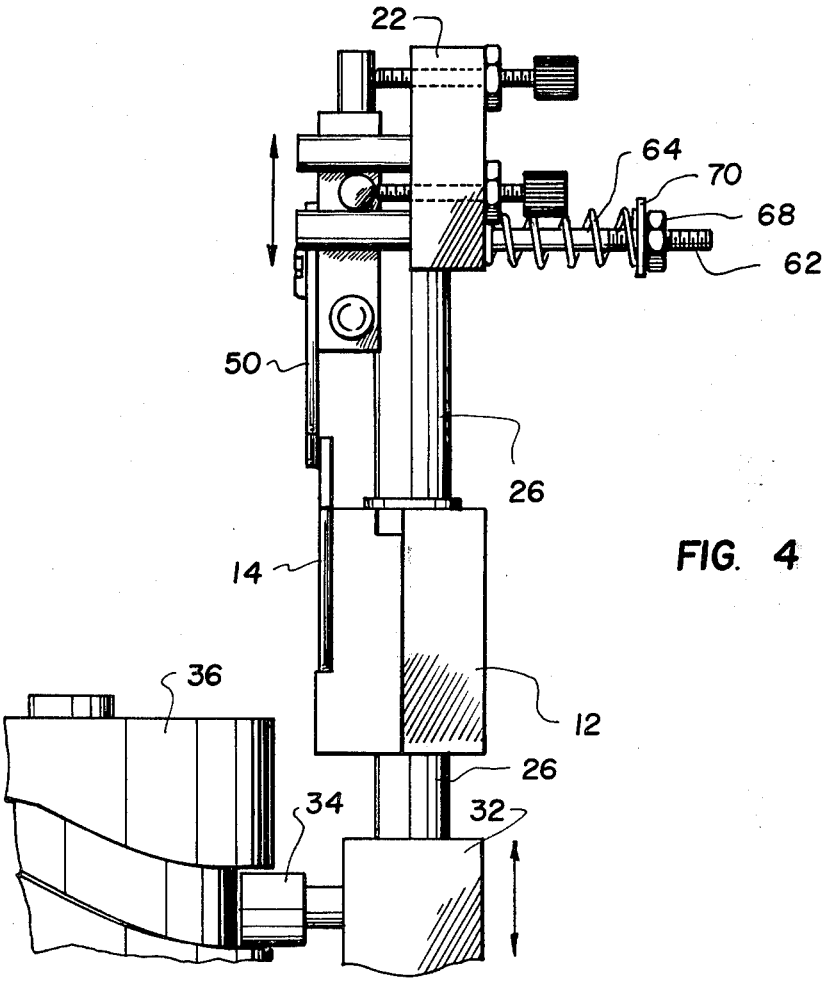
FIG. 4

CUTTER ASSEMBLY FOR CUTTING STRIP MATERIAL

FIELD AND BACKGROUND OF THE INVENTION

This invention relates in general to devices for severing strip material and in particular to a new and useful device for severing strip material particularly that kind which includes plastic fibers and which includes an accurate means for guiding the movable blade relative to a fixed blade over which the materials to be severed are fed.

In recent years most of the labels which appear on clothing and similar items are manufactured with thermoplastic threads so that they may be heat sealed in position to the garment rather than to require that they be sewed on the garment. Labels which are made for such purpose are usually made into rolls and they must be severed individually from the rolls and packaged in containers before they are applied to the garments. It is very difficult to cut such materials and it has been found that to accurately cut it on a continuous basis, it is necessary that the materials be heated. With the known methods today, a disadvantage is that the cutting area becomes fouled and the operation must be discontinued for the cleaning of the blades and their realignment.

SUMMARY OF THE INVENTION

In accordance with the present invention there is provided a cutter assembly for cutting strip materials which includes a fixed blade mounted to a fixed support and a movable blade assembly mounted to a movable member which is reciprocated upwardly and downwardly relative to the fixed support. In the inventive arrangement the movable blade is mounted on the movable member in a manner so that it may be adjusted outwardly and inwardly in respect to its associated movable member so that the cutting edge of the movable blade may be accurately aligned with the cutting edge of the fixed blade to achieve the most desirable cut. Since the blades which are used are blades which are quite brittle and subject to destruction such as blades having high carbon content steel, considerable care must be used to see that the movable blade cooperates with the fixed blade in a manner such that an accurate cut is produced without destroying any of the surface of the blade. With the inventive arrangement, the movable blade assembly is mounted so that it may be adjusted outwardly and inwardly in respect to its associated movable member, and in addition it is biased by springs at two separate lateral locations in a direction toward the movable member. The arrangement is such that threaded adjustment screws carried by the movable member may be adjusted to accurately position the blade by adjustments made at four distinct locations so that the blades will be accurately positioned during their operation.

In a further feature of the invention the fixed blade is provided with an upstanding portion adjacent one end thereof which forms a marginal edge guide for the upper blade and provides a bearing surface for this blade during the up and downward cutting movement thereof.

Accordingly, it is an object of the invention to provide an improved cutter assembly for cutting strip material which includes a movable assembly which is mounted on a movable member so that it may be adjusted inwardly and outwardly at diverse lateral locations along its length for accurate positioning in respect to a fixed blade over which the strip materials to be cut is fed.

A further object of the invention is to provide a cutter assembly which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1 is a front elevational view of a cutter assembly for cutting labels constructed in accordance with the invention;

FIG. 2 is partial top plan view on a reduced scale showing the feeding of the strip material and the adjustable positions of the movable blade assembly relative to the movable member;

FIG. 3 is an exploded perspective view showing the assembly of the movable blade relative to the fixed blade; and FIG. 4 is a partial end elevational view of the cutter assembly indicating a schematic drive for the movable blade.

DESCRIPTION OF THE PREFERRED EMBODIMENT

Referring to the drawings in particular the invention embodied therein comprises a cutter assembly generally designated 10 which includes a fixed support 12 with a fixed blade 14 in the form of a flat plate member of high carbon steel secured to the support, for example by means of screws 16. A top edge 18 of the fixed blade defines a cutting edge. Guideway means on the support 12 for guiding a movable blade comprises a marginal edge portion 20 of the fixed blade 14 which extends upwardly above the cutting edge on only one side of the blade 14.

A movable member 22 in the form of a slide block is mounted on spaced guide rods 24 and 26 which slide in rolling contact with roller bearing guides 28 and 30 of the fixed support 12. A block member 32 is affixed to the guide rods 24 and 26 on the opposite side of the fixed support 12. Block 32 advantageously carries a roller follower 34 which is engaged on a cam 36 which is continuously rotated by a drive (not shown).

In accordance with the invention guideway means in the form of vertically spaced pintles 38 and 40 which extend horizontally outwardly from the associated movable member 22 and corresponding lateral guideway means defined by pintles 42 and 44 at spaced location from the first set provide a means for associating the movable blade assembly generally designated 46 with the movable member 22. The movable blade assembly 46 includes a block portion 48 and a flat blade portion 50 which comprises a movable cutting blade. The block portion 48 has a guide portion in the form of a pintle 52 and pintle 54 which extend outwardly from respective opposite ends and engaged between the pintles 42 and 44 and 38 and 40 respectively of the movable member 22. In addition the block member has upstanding pintles 56 and 58 at laterally spaced locations which will provide means for adjusting the position of the assembly 46 relative to the movable member 22. Two threaded bolts 60 and 62 are carried on the block 48 at laterally spaced locations engaged through bores of the member 22 and they carry a compression spring 64 and 66 which acts to bias the block 48 in a direction toward the member 22. The biasing force may be adjusted by a threaded nut 68 threaded on the associated bolt 60 or 62 and which bears against a washer 70 to vary the biasing force of the associated springs.

The inventive arrangement has adjustment means which acts against the biasing force of the spring to accurately position the block member relative to the associated movable member 22 and to the fixed blade 14. This adjustment means includes a plurality of threaded adjustment members including adjustment screws 72 and 74 which may adjustably bear against the upstanding pintles 56 and 58 and adjustment screws 76 and 78 which may be adjustably threadably arranged to bear against the guide pintles 54 and 52. The adjustment screw 72, 74, 76 and 78 may be easily turned such as by a turning tool engaged in the head thereof to provide for an accurate positioning of the blade 50 so that it will cooperate without stress with the blade 14 during the reciprocation of the movable member 22. In addition, the blade guide formed by the extension of the fixed blade 14 in the form of the blade guide for the movable blade 20 is such that the adjustment of the blades for cooperative engagement may be accurately made during all stages of operation of the device.

It has been found preferable that a heater 80 be carried by the movable block 48 and it is advantageously an electrical resistance heater which may be connected by a connecting wire 82. In this manner the heat is transferred to the material being cut by the movable blade 50 and the arrangement has proved satisfactory in effecting a fast cut of the material without clogging up the cutting area.

While a specific embodiment of the invention has been shown and described in detail to illustrate the application of the principles of the invention, it will be understood that the invention may be embodied otherwise without departing from such principles.

What is claimed is:

1. A cutter assembly for cutting strip material into individual lengths, comprising a fixed support, a fixed blade having a first side secured to said support and an opposite second side and having a top cutting edge over which the strip material to be cut is fed, a movable member movable upwardly and downwardly relative to said fixed blade, guideway means defined at laterally spaced locations on said movable member, means connected to said movable member to move it upwardly and downwardly, a movable blade assembly including a block portion and a blade portion, said block portion having a guide portion extending laterally outwardly from each end and confined in respective guideway means, said blade portion having a bottom knife edge cooperable with said top cutting edge of said fixed blade to sever the strip material, spring means acting between said movable blade assembly and said movable member to urge said movable blade toward said movable member, and a plurality of threaded adjustment members threaded to said movable member and acting on said movable blade assembly at laterally and vertically spaced locations to adjust the position of said movable blade assembly relative to said movable member and said fixed blade.

2. A cutter assembly according to claim 1, including a blade guide for the movable blade secured to said fixed support and extending upwardly above said fixed blade adjacent one end thereof in a position to guide a slidable guide engagement with a marginal end portion of said movable blade assembly portion.

3. A cutter assembly according to claim 1, wherein said guideway means defined at laterally spaced locations on said movable member comprises separate pairs of vertically spaced apart pintles, said block member guide portion including a guide pintle extending outwardly from each respective end of said block member.

4. A cutter assembly according to claim 3, including a guide pintle extending vertically upwardly from said block member at two laterally spaced locations, said threaded adjustment members including a threaded screw threaded to said movable member and bearing against each of said end pintles and said vertically extending pintles.

5. A cutter assembly according to claim 4, wherein said block member includes a bolt extending through said movable member, said spring means including a coil spring engaged on said threaded bolt member and threaded nut means on said bolt member for adjusting the tension of said spring.

6. A cutter assembly according to claim 5, including a blade guide for the movable blade comprising a portion of said fixed blade adjacent an end thereof extending upwardly from said top cutting edge.

* * * * *